United States Patent [19]

Koide

[11] Patent Number: 5,056,717

[45] Date of Patent: Oct. 15, 1991

[54] ELECTROMAGNETIC OPERATED SPRAYER WITH A LOCKING MECHANISM

[75] Inventor: Takanori Koide, Ebina, Japan

[73] Assignee: Showa Seiki Kogyo Kabushiki Kaisha, Kanagawa, Japan

[21] Appl. No.: 584,760

[22] Filed: Sep. 19, 1990

[30] Foreign Application Priority Data

Oct. 3, 1989 [JP] Japan ..... 1-115889[U]
Oct. 3, 1989 [JP] Japan ..... 1-115890[U]

[51] Int. Cl.[5] ..... B05B 9/04
[52] U.S. Cl. ..... 239/332; 285/311
[58] Field of Search ..... 239/332; 222/333, 383, 222/324, 372; 70/229-232; 285/311, 312; 292/DIG. 49

[56] References Cited

U.S. PATENT DOCUMENTS 4,160,525 7/1979 Wagner ..... 239/332
4,693,423 9/1987 Roe et al. ..... 239/332
4,768,006 8/1988 Trift et al. ..... 285/311

FOREIGN PATENT DOCUMENTS 2336986 2/1975 Fed. Rep. of Germany ..... 239/332

*Primary Examiner*—Andres Kashnikow
*Assistant Examiner*—Lesley Morris
*Attorney, Agent, or Firm*—Toren, McGeady & Associates

[57] ABSTRACT

An airless sprayer is disclosed. A power sprayer equipped with an electromagnetic operated mechanism is easy in handling and simple in operation.

However, in taking out a nozzle head, a piston pump and the like for the purpose of cleaning, it is very difficult to take them out and cumbersome to do so. Assembling is not easy.

Taking-out operation and assembling operation of the nozzle head, the piston pump and the like can be accomplished easily whereby cleaning can be easily accomplished. The power sprayer of this kind can be used more conveniently.

5 Claims, 12 Drawing Sheets

ELECTROMAGNETIC OPERATED SPRAYER WITH A LOCKING MECHANISM

BACKGROUND OF THE INVENTION

This invention relates to an airless type sprayer which eliminates the provision of a compressor and which directly compresses a coating to inject the coating from a nozzle.

More specifically, the present invention relates to a sprayer in which a piston of a piston pump for pumping paint within a container to spray the paint is moved forward and backward by means of a movable iron piece of an electromagnet and a return spring attached to a cylinder of the piston.

As is known, a coater of this kind is designed so that a piston is moved forward and bakward by means of a movable iron piece of an electromagnet encased therein and a return spring attached to a cylinder of the piston whereby a coating is pumped from a coating container in communication with the cylinder, and the coating can be injected in the form of a mist through a nozzle mounted on the extreme end of the cylinder.

In the coater of this kind, a bottle-like coating container is directly mounted thereon, and the coater is connected to an AC source of normally 100 volt to 115 volt. Then, the coater can spray a coating without using a compressor. Therefore, there are merits in that the coater can be used in a general home having no compressor and can be handled easily.

The coater of this kind is disclosed, for example, in Japanese Utility Model Publication No. 53(1078)-15,818. The essential parts of the coater will be described with reference to FIG. 19. A casing 2 having a grip 1 is interiorly formed with a piston pump mounting portion 3, and a piston pump 4 is fitted in the piston pump mounting portion 3. The piston pump 4 is composed of a cylinder 5, a piston 6 and a valve set 7. A rod portion 6*a* of the piston 6 is inserted into a rear hole 5*a* of the cylinder 5, and a valve set 7 is fitted in a front hole 5*b*. One end of the piston 6 forms a flange portion 6*b*. A return spring 8 fitted in the piston 6 is interposed between the rear end of the cylinder 5 and the flange portion 6*b* of the piston 6. A nozzle head 9 is placed in contact with the front end of the cylinder 5. Provided near the front end interiorly of the cylinder is a check valve 12 which is urged by means of a spring 11 provided relative to a nozzle piece 10 to prevent a back flow of fluid. The extreme end of the rod portion 6*a* of the piston 6 can be placed in contact with the check valve 12 of the valve set 7.

The interior of the cylinder 5 provided with the check valve 12 forwardly thereof forms a pump chamber 13 to which faces the extreme end of the piston 6.

The piston pump mounting portion 3 is formed in its lower end with a coating container mounting portion 14. An upper portion of a suction pipe 16 is inserted into a suction pipe mounting portion 15 of the coating container mounting portion 14, and a coating container 17 is mounted on the coating mounting portion 14.

The cylinder 5 is provided with a through-hole 18 in communication with a pump chamber 13 and a through-hole 19 located at the rear thereof to return to the coating container 17 the coating adhered to the piston 6 and moving backward. When the cylinder 5 is set and the coating container 17 is mounted, the through-holes 18 and 19 are communicated with through-holes 20 and 21, respectively, provided in the casing 2. These through-holes 20 and 21 have their lower ends opened into the coating container 17. The suction pipe 16 has a length reaching the inner bottom of the coating container 17. A strainer 22 is mounted on the suction pipe 16.

The casing 2 is interiorly provided with an electromagnetic operated mechanism 23 in which an upper end of a movable iron piece 25 is mounted on the upper end of a fixed core 24 so that a coil 26 is excited to attract the movable iron piece 25. The piston 6 is moved forward by the movement of the lower end of the movable iron piece 25 resulting from the actuation of the electromagnetic operated mechanism 23 whereas the piston 6 is moved backward by the resilient force of the return spring 8.

In other words, the piston 6 is moved forward by being pressed by the movable iron piece 25 of a clapper type electromagnet and moved backward and returned by the resilient pressing force of the return spring 8. An adjusting rod 27 for changing a stroke of the piston 6 for the purpose of changing a discharge amount of coating is provided at the rear of the casing 2. The adjusting rod 27 is in the form of a bottle with a knob. A damper and electric insulator 28 is mounted on the end in contact with the movable iron piece 25. A power switch 29 is provided on the grip 1, and a power cord 30 is mounted. Necessary electric members, wirings and the like are provided on the grip and in the casing.

In the coater as described above, in the case where coating is accomplished using different kinds of coatings, in the case where a coater is not used for a long period of time, and in the case where the coating becomes stopped up during coating, it is necessary to clean a nozzle head 9, a piston pump 4 and the like.

For cleaning, the nozzle head 9, the piston pump 4 and the like have to be removed from the casing 2. In the coater of this kind, the procedure of removing the nozzle head 9, the piston pump 4 and the like during the cleaning is generally carried out as shown in FIG. 20. First, the suction pipe 16 is removed, the nozzle head is removed, the nozzle piece 10 as a stop ring by which the cylinder 5 is secured to the casing 2 is removed, the piston pump 4 is removed, the valve set 7 is removed, the piston 6 is removed and the return spring 8 is removed. These nozzle head 9, cylinder 5, piston 6 and the like are cleaned by a brush using a cleaning liquid. Particularly, assurance should be made to see if air holes become stopped up. Thereafter, these parts are assembled into the procedure reversed to that used during cleaning. That is, the piston 6 is mounted, the valve set 7 is mounted, the piston pump 4 portion is formed, the nozzle piece 10 is mounted, the nozzle head 9 is mounted and the suction pipe 16 is mounted to complete assembling.

SUMMARY OF THE INVENTION

The present invention relates to an airless type sprayer in which a piston of a piston pump for pumping paint within a container to spray it is moved forward and backward by means of a movable iron piece of an electromagnetic operated mechanism and a return spring attached to a cylinder of said piston, and a coating is directly compressed to spray it from a nozzle.

It is an object of the present invention to provide a sprayer in which mounting and removal of a nozzle head and a piston pump can be easily carried out, and removal during cleaning and assembling after cleaning can be carried out effectively.

It is a further object of the present invention to provide a sprayer in which a left lock and a right lock provided on opposite sides, respectively, of a casing can be operated so as to remove a piston pump in a one-touch manner, and assembling of the piston pump can be also accomplished in a one-touch manner.

It is another object of the present invention to provide a sprayer in which said left lock and said right lock are formed by a front lock and a rear lock, respectively, so that the rear lock is turned frontwardly or rearwardly in a plane whereby the piston pump can be removed and mounted.

It is still another object of the present invention to provide a sprayer in which a cylinder is formed with a cylinder mounting pin contacting recess, and a left and right locks having a cylinder mounting pin are mounted on a piston pump cover portion of a casing whereby a knob of a rear lock is held by the thumb and an index finger so as to raise the rear lock, and the lock is turned frontwardly so that removal of a nozzle head, a piston pump or the like is accomplished very easily in a one-touch manner and assembling in the procedure reversed to that used during cleaning can be made in a one-touch manner.

It is another object of the present invention to provide a sprayer in which mounting and removal of a left lock and a right lock are made easily to improve operability of assembling, disassembling and the like, improve maintenance and render replacement of a lock easy.

DETAILED DESCRIPTION OF THE INVENTION

Embodiments of the present invention will be described in detail hereinafter with reference to the drawings.

A coater according to the present invention is particularly characterized in that a left lock and a right lock provided on opposite sides, respectively, of a casing can be operated to remove and mount a nozzle head, a piston pump and the like in a one-touch manner.

Figure 1:
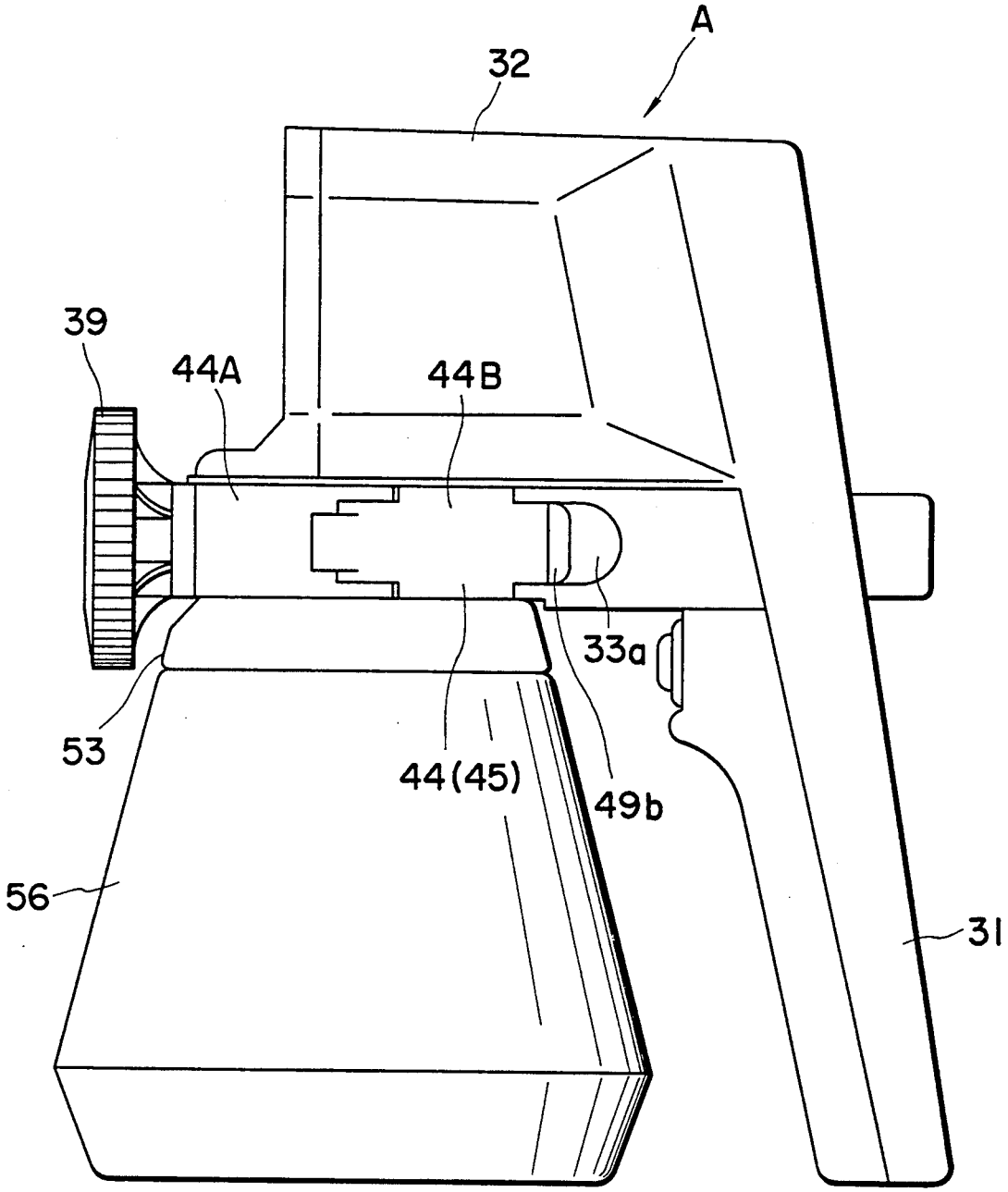
FIG. 1 is a side view of a coater according to the present invention.
Figure 2:
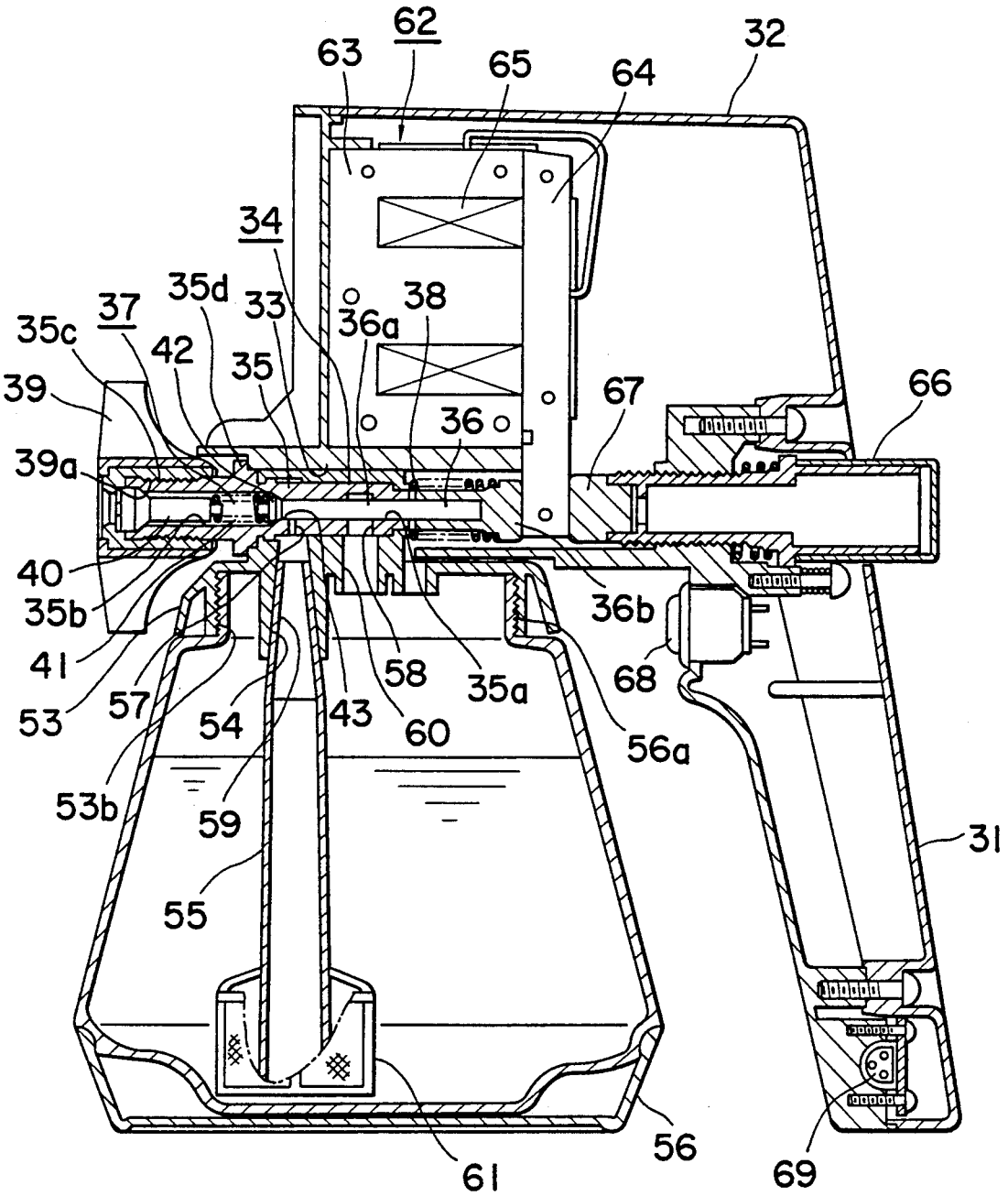
FIG. 2 is a longitudinal sectional side view of same.

A coater according to the present invention will be described with reference to FIGS. 1, 2 and 3.

In a coater A of the present invention, a casing having a grip 31 is interiorly formed with a piston pump cover portion 33, and a piston pump 34 is fitted in the piston pump cover portion 33. The piston pump 34 comprises a cylinder 35, a piston 36 and a valve set 37. A rod portion 36*a* of the piston 36 is inserted into a rear hole 35*a* of the cylinder 35, and the valve set 37 is fitted in a front hole 35*b*. One end of the piston 36 forms a flange portion 36*b*. A return spring 38 fitted in the piston 36 is interposed between the rear end of the cylinder 35 and the flange portion 36*b* of the piston 36. A nozzle head 39 is placed in contact with the front end of the cylinder 35. A check valve 42 which is urged by a spring 41 provided relative to a nozzle piece 40 to prevent rearward backflow of fluid is provided in the vicinity of the front end interiorly of the cylinder 35. The extreme end of the rod portion 36*a* of the piston 36 is placed in contact with the check valve 42 of the valve set 37.

The interior of the cylinder 35 with the check valve 42 disposed frontwardly forms a pump chamber 43 to which faces the extreme end of the piston 36.

The cylinder is formed in its front outer periphery with an external thread 35*e*, which engages an internal thread 39*a* formed in a hole of the nozzle head 39 whereby the nozzle head 39 is mounted.

Figure 3:
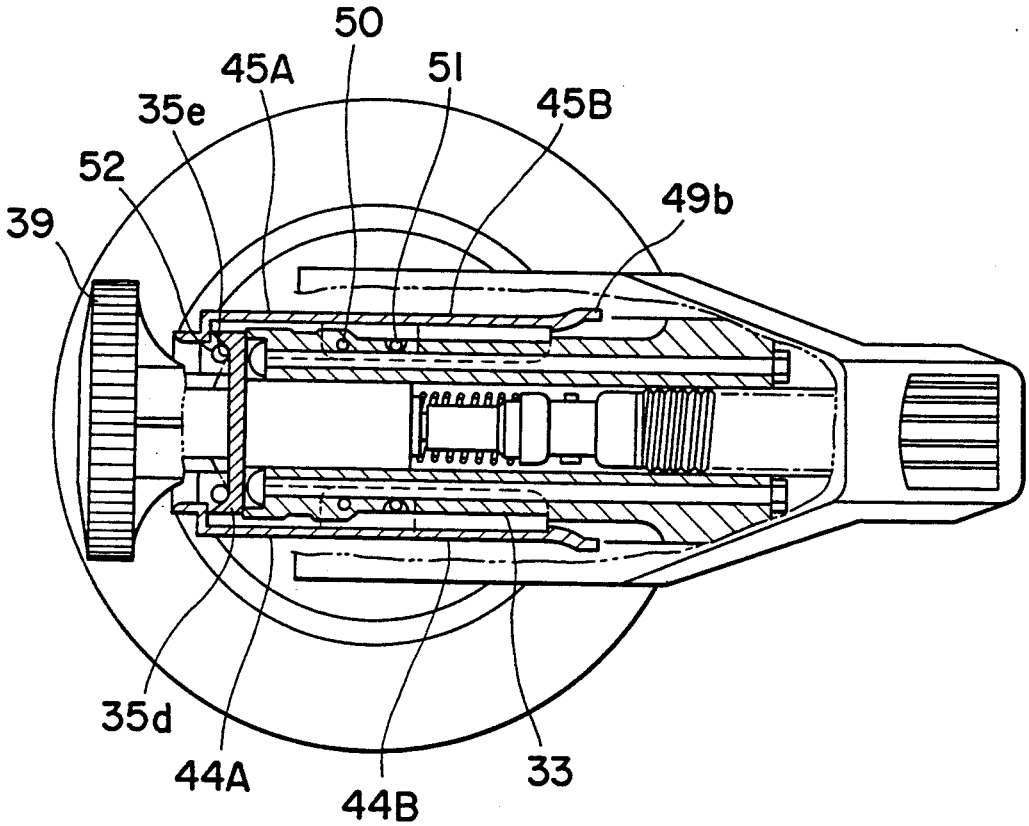
FIG. 3 is a partly cutaway plan view of the same.
Figure 4:
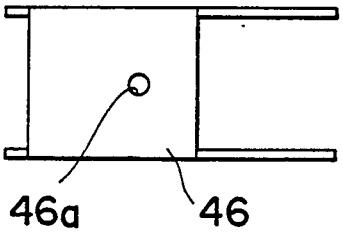
FIG. 4 is a front view of a base plate of a front lock portion of a left lock.
Figure 5:
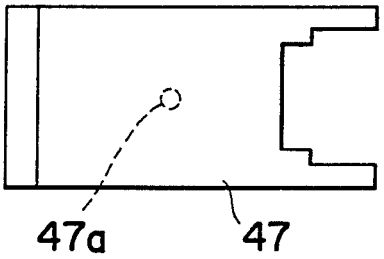
FIG. 5 is a front view of a cover for a front lock portion of a left lock.
Figure 6:
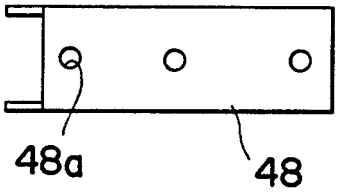
FIG. 6 is a front view of a base plate for a rear lock portion of a left lock.
Figure 7:
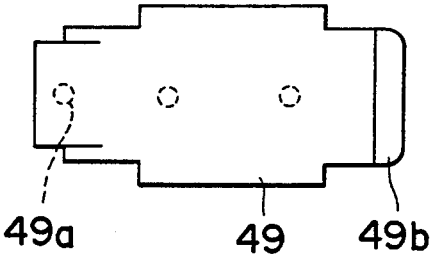
FIG. 7 is a front view of a cover for a rear lock portion of a left lock.

An extending portion 35*d* extended outwardly and toward both sides is provided at the rear of the external thread 35*c* of the cylinder 35, and the extending portion 35*d* is formed in its both left and right sides and front with a cylinder mounting pin contacting recess 35*c* (see FIG. 3).

On a piston pump cover portion 33 of the casing 32 are mounted a pair of left lock 44 and right lock 45 which are symmetrical in shape and have the same size. As shown in FIGS. 4 to 10, the left lock 44 comprises a front lock portion 44A and a rear lock portion 44B. A locating hole portion 46*a* of a metal front lock base plate 46 is fitted in a locating convex portion 47*a* of a plastic front lock cover 47 to connect between the front lock base plate 46 and the front lock cover 47 to constitute the front lock portion 44A. A locating hole portion 48*a* of a metal rear lock base plate 48 is fitted in a locating convex portion 49*a* of a plastic rear lock cover 49 to connect between the rear lock base plate 48 and the rear lock cover 49 to constitute the rear lock portion 44B. A front end of the rear lock portion 44B is pivoted to the piston pump cover portion 33 by means of a rear lock mounting pin 50, and a rear end of the front lock portion 44A is pivoted to a front end of the rear lock portion 44B by means of a connecting pin 51.

The right lock 45 is similar in shape to and the same in size as the left lock 44.

A cylinder mounting pin 52 is secured to front ends of front lock portions 44A and 45A of the left lock 44 and the right lock 45, respectively, so that a cylinder mounting pin 52 is fitted in and placed in contact with the cylinder mounting pin contacting recess 35*e* during mounting of the cylinder. Rear ends of the rear lock portions 44B and 45B of the left lock 44 and the right lock 45, respectively, form knobs 49*b* so that the latter is received into a recess 33*a* formed in the side of the piston pump cover portion 33.

A coating container mounting body 53 is secured to the lower portion of the piston pump cover portion 33. An upper portion of a suction pipe 55 is inserted into a suction pipe mounting portion 54 of the coating container mounting body 53. An internal thread 53*b* of the coating container mounting body 53 is meshed with an external thread 56*a* of a coating container 56 to mount the coating container 56.

The cylinder 35 is provided with a through-hole 57 in communication with the pump chamber 43 and a through hole 58 at the rear thereof to return a coating adhered to the piston 36 and moving rearward to the coating container 56. When the cylinder 35 is set and the coating container 56 is mounted, the through-holes 57 and 58 are communicated with through-holes 59 and 60, respectively, of the coating container mounting body 53 and opened into the coating container 56. The suction pipe 55 has its length reaching the inner bottom of the coating container 56. A strainer 61 is mounted on the suction pipe 55.

The casing 32 is interiorly equipped with an electromagnetic operated mechanism 62 in which an upper end of a movable iron piece 64 is mounted on the upper end of a fixed core 63 and a coil 65 is excited so as to attract the movable iron piece 64. The piston 36 is moved forward by forward movement of the lower end of the movable iron piece 64 resulting from actuation of the electromagnetic operated mechanism 62 whereas the piston 36 is moved backward by the resilient force of the return spring 38.

The piston 36 is moved forward by being pressed by the movable iron piece 64 of a so-called clapper type electromagnet and is moved backward and returned by the resilient pressing force of the return spring 38. An adjusting rod 66 for changing a stroke of the piston 36 for the purpose of changing a discharge amount of coating is provided at the rear of the casing 32. The adjusting rod 66 is in the form of a bottle with a knob. A damper and electric insulator 67 is mounted on the contact end to the movable iron piece 64. A power switch 68 is provided on the grip 31, and a power cord mounting portion 69 is provided. The grip 31 and the casing 32 are interiorly provided with necessary electric members, wirings and the like.

The present invention is constructed as described above The piston 36 is pressed and moved forward by the movable iron piece 64 which is reciprocated at a high speed with high speed repetition of energization and deenergization and moved backward at a high speed by release of the force of the return spring 38.

In the sprayer according to the present invention, the nozzle head 39 and the piston pump 34 can be removed in the following procedure.

Figure 11:
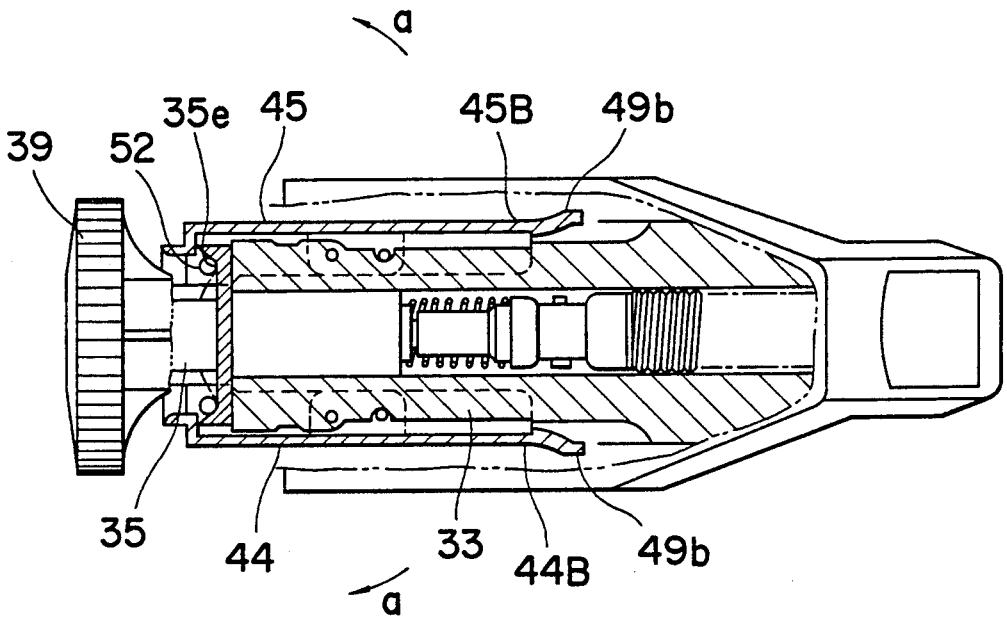
FIG. 11 is an explanatory view showing a state where a piston pump is mounted.
Figure 12:
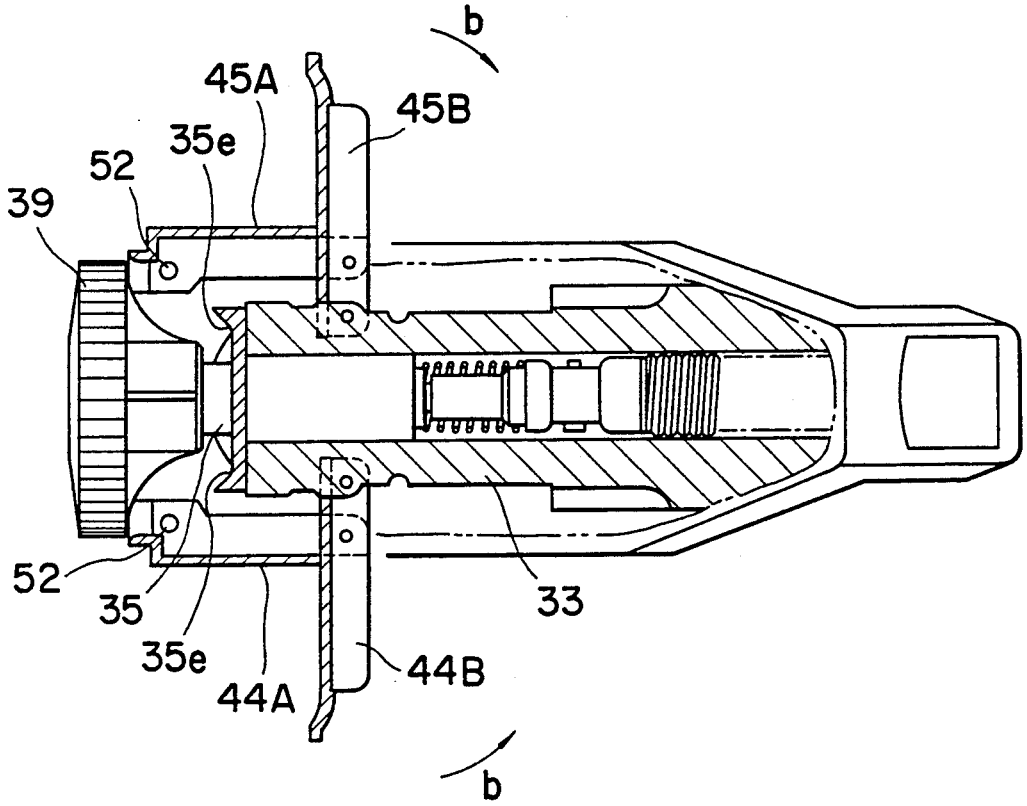
FIG. 12 is an explantory view showing a state where a rear lock portion is turned frontwardly.

First, as shown in FIG. 11, the knobs 49*b* of the rear lock portions 44B and 45B of the left lock 44 and the right lock 45, respectively, are held by the thumb and an index finger to turn them forwardly in a direction as indicated at arrow a. Thereby, as shown in FIG. 12, the front lock portions 44A and 45A are moved forward while being moved away from the casing 32, and at the same time, the cylinder mounting pin 52 is slipped out of the cylinder mounting pin contacting recess 35*e*. At the same time, the nozzle head 39 is moved somewhat forward by being pressed by the front lock portions 44A and 45A. Accordingly, the cylinder 35 is also moved somewhat forward.

Figure 13:
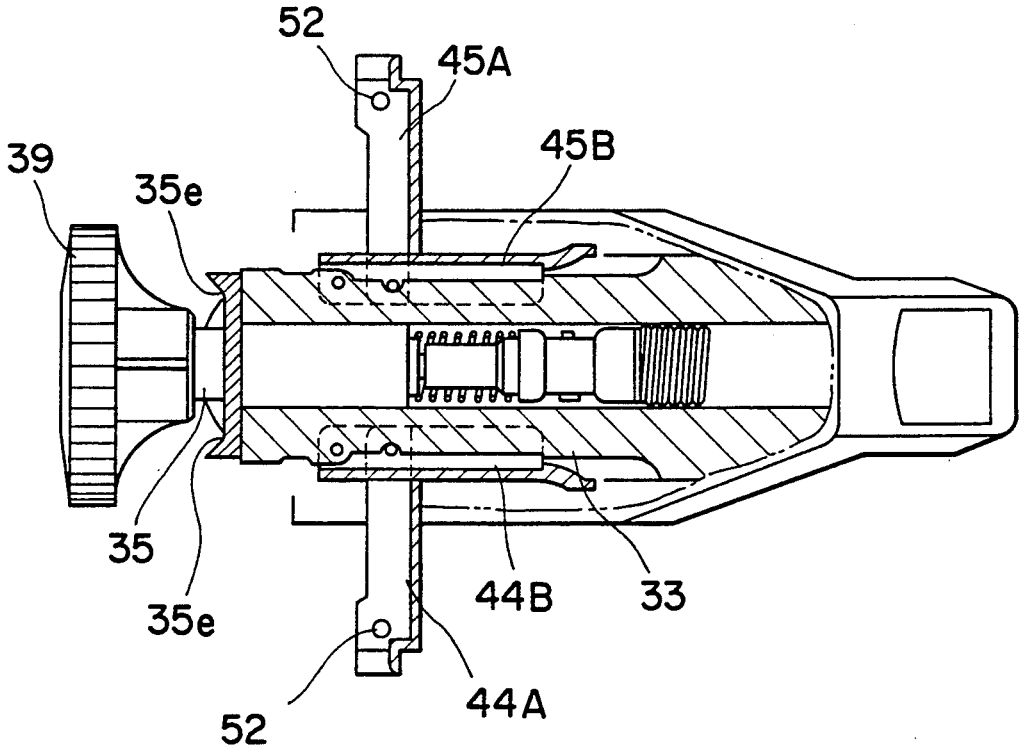
FIG. 13 is an explantory view showing a state where a rear lock portion is turned rearwardly.

Next, the rear lock portions 44B and 45B are turned backward in a direction as indicated at arrow b, as shown in FIG. 12, and the front lock portions 44A and 45A are positioned in a direction substantially perpendicular to the axial direction of the cylinder 35 in a horizontal plane, as shown in FIG. 13.

Thereafter, when the nozzle head 39 and the cylinder 35 are pulled forward in an axial direction of the cylinder 35 by one hand, the nozzle head 39, the cylinder 35, the piston 26 and the like can be easily removed.

After these have been removed and cleaned by a cleaning liquid, they are assembled.

The procedure for assembling and removal is carried out in the procedure reversed to the former.

That is, the nozzle head 39 and the cylinder 35 are held by one hand and pressed from the front along the axial direction of the cylinder 35. The rear lock portions 44B and 45B of the left body 44 and the right lock body 45, respectively, are fallen rearward in a horizontal plane, and at the same time, the cylinder mounting pin 52 is fitted in the placed in contact with the cylinder mounting pin contacting recess 35*e*. The rear lock portions 44B and 45B are placed in contact with the side of the piston pump cover portion 33 to complete mounting of the nozzle head 39, the cylinder 35 and the piston pump 34.

FIGS. 14 to 18 show a modified mounting construction of the lock.

In this case, mounting and removal of the lock can be made easy to improve operabilities of assembling, disassembling and the like.

Figure 8:
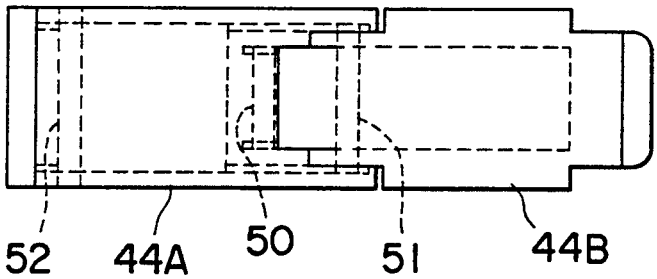
FIG. 8 is a front view of a left lock.
Figure 9:
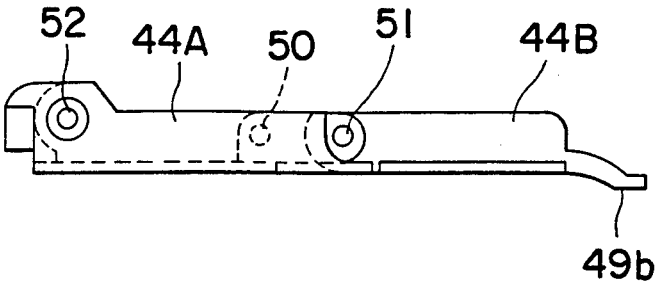
FIG. 9 is a plan view of a left lock.
Figure 10:
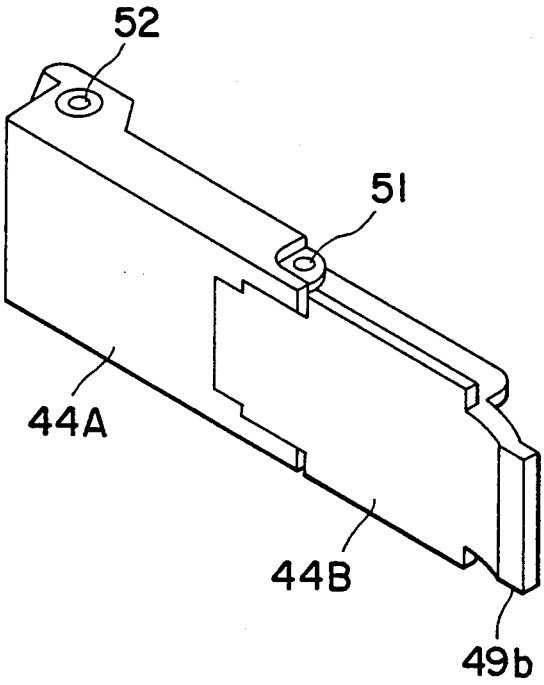
FIG. 10 is a perspective view of a left lock.
Figure 14:
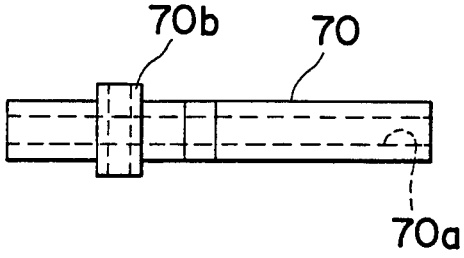
FIG. 14 is a front view of a screw insert member of a left lock.
Figure 15:
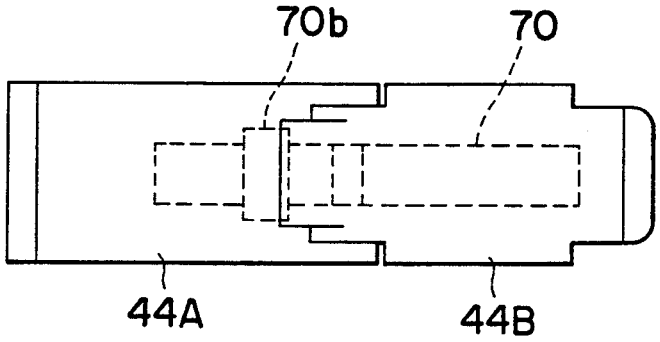
FIG. 15 is a front view of a left lock in the case where the left lock is easily mounted and removed by a mounting screw.
Figure 16:
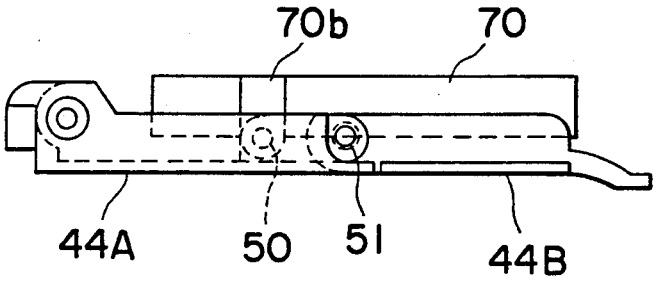
FIG. 16 is a plan view of a left lock in the case where the left lock is easily mounted and removed by a mounting screw.

As shown in FIGS. 14 to 16, in the left lock 44 and the right lock 45, a screw insert member 70 is provided on the rear lock portions 44B and 45B, the screw insert member 70 being formed with a screw insert hole 70*a*. The screw inert member 70 is formed with a rear lock mounting portion 70*b*, and the front ends of the rear lock portions 44B and 45B are pivoted to the rear lock mounting portion 70*b* by means of a rear lock mounting pin 50. In the left lock 44 and the right lock 45, the rear ends of the front lock portions 44A and 45A are pivoted to the front ends of the rear lock portions 44B and 45B by means of a connection pin 51 as shown in FIGS. 8, 9 and 10.

Figure 17:
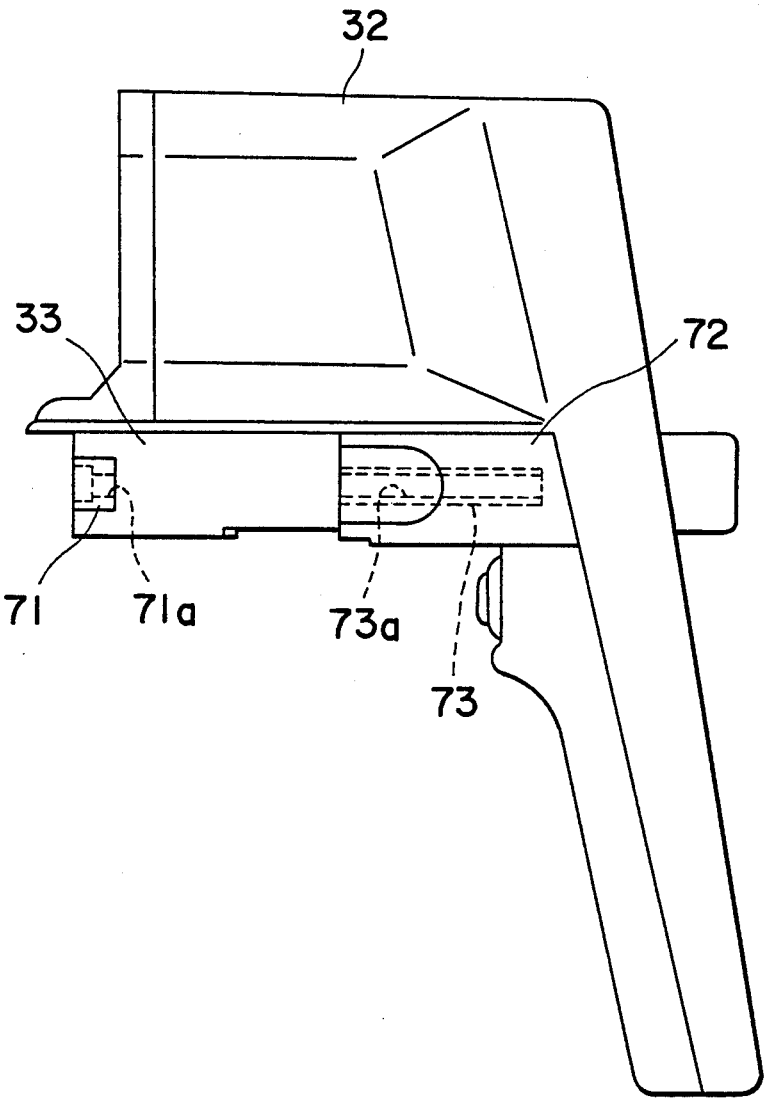
FIG. 17 is a side view of essential parts of a piston pump cover portion in the case where a left lock is easily mounted and removed by a mounting screw.
Figure 18:
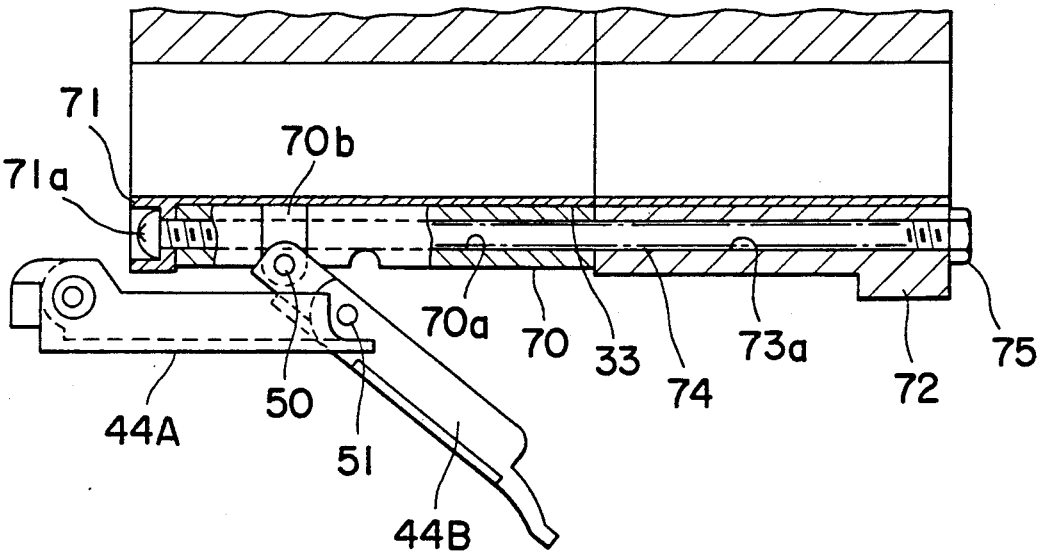
FIG. 18 is a plan view of essential parts showing a mounting construction in the case where a left lock is easily mounted and removed.
Figure 19:
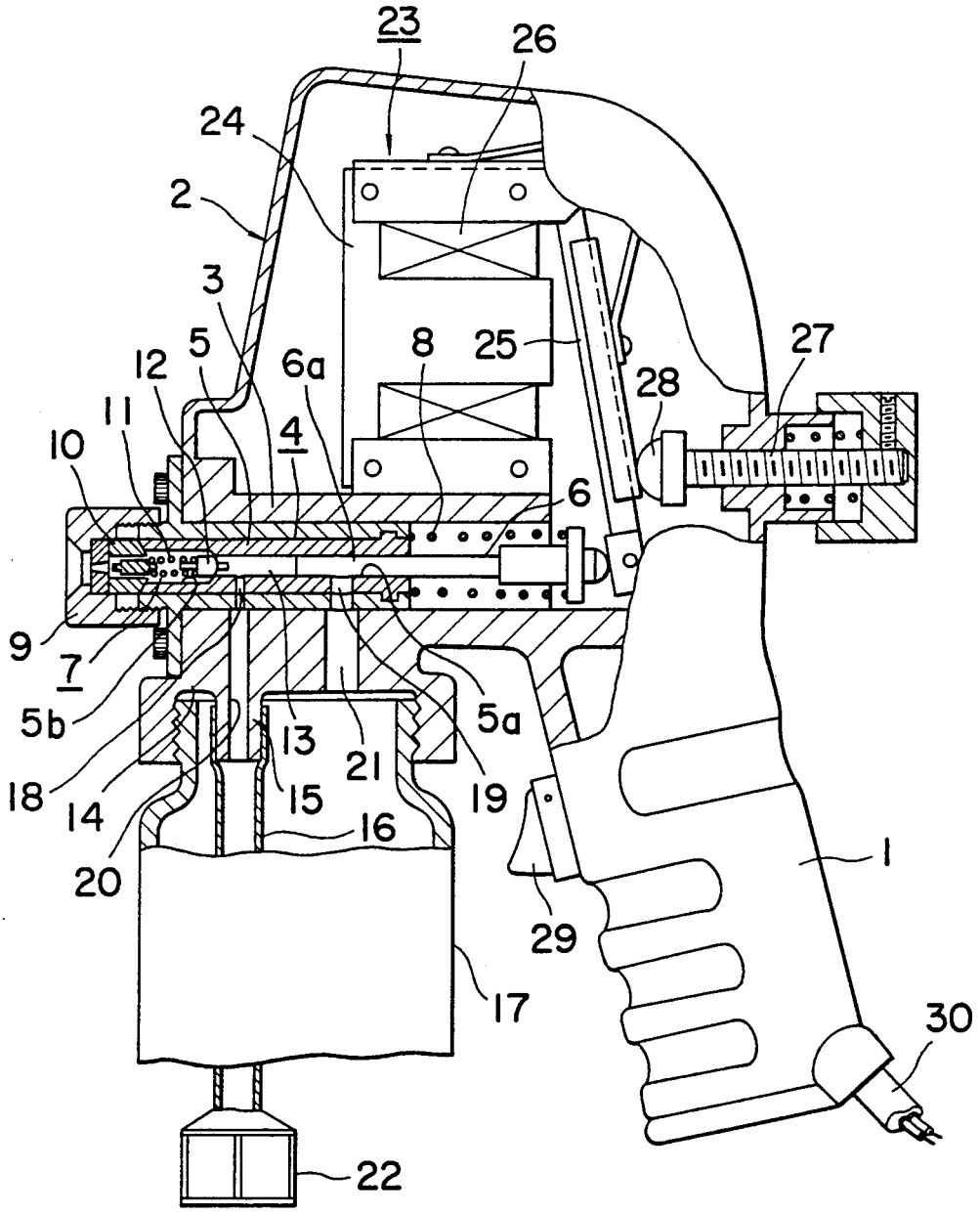
FIG. 19 PRIOR ART
FIG. 19 is a cutaway sectional view of essential parts showing one example of a conventional coater.
Figure 20:
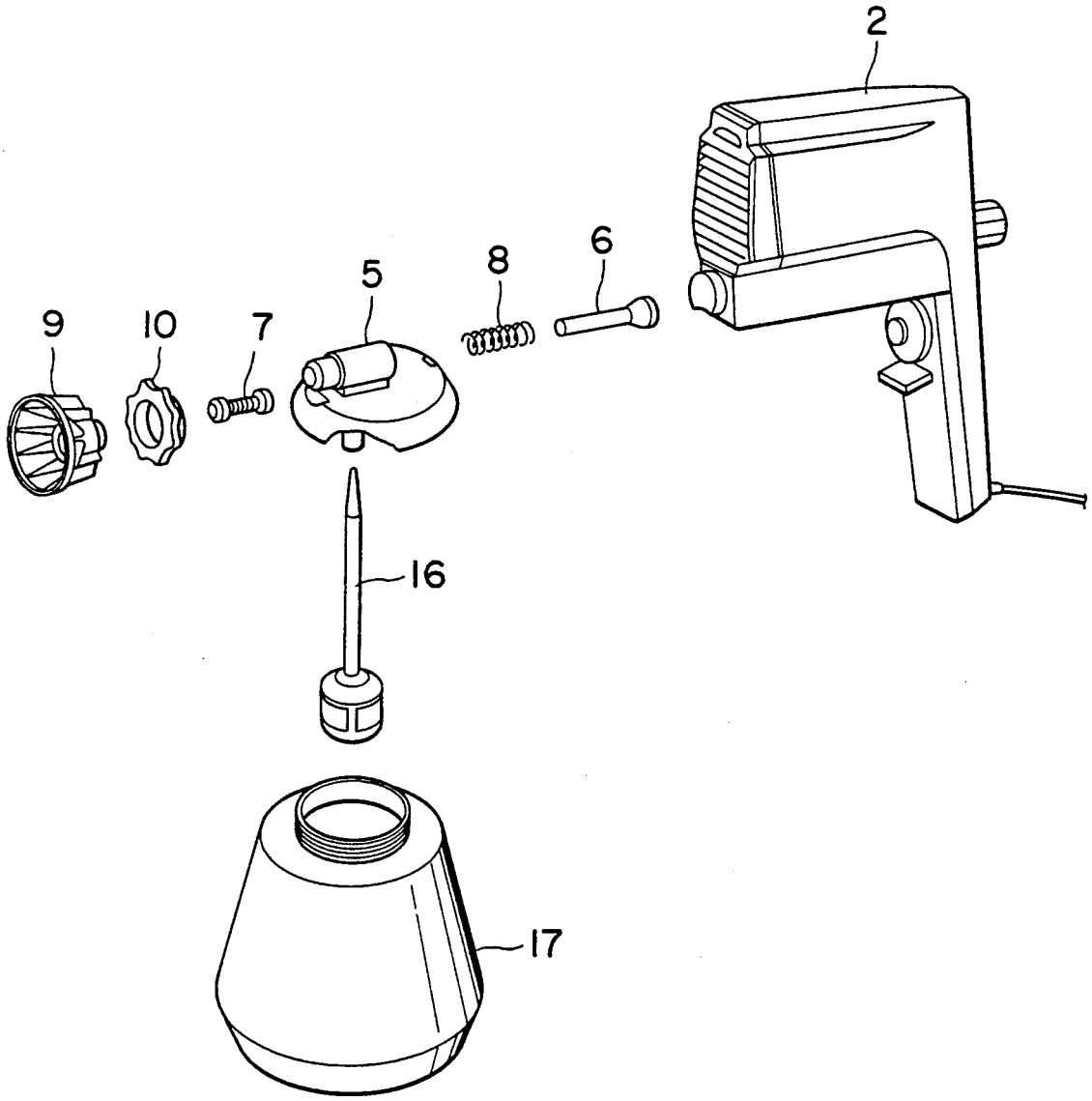
FIG. 20 is an explanatory view showing a procedure for removing and mounting a nozzle head, a piston pump and the like of a conventional coater.

As shown in FIGS. 17 and 18, a front screw insert portion 71 is provided on the piston pump cover portion 33 of the casing 32, the front screw insert portion 71 being formed with a screw insert hole 71*a*. A rear screw insert portion 73 is provided on the stopper cover portion 72 of the casing 32, the rear screw insert portion 73 being formed with a screw insert hole 73*a*. The screw insert hole 71*a* and the screw insert hole 73*a* are coaxial with each other.

As shown in FIGS. 17 and 18, the left lock 44 and the right lock 45 are placed in contact with the piston pump cover portion 33 from the side. The screw insert holes 70*a*, 71*a* and 73*a* are coaxial with each other. A mounting screw 74 is inserted from the front into screw inert holes 70*a*, 71*a* and 73*a* and tightened by a nut 75 so as to mount them on the piston pump cover portion 33.

Accordingly, in the case of the lock mounting construction as shown in FIGS. 14 and 18, the locks 44 and 45 can be immediately removed by removing the nut 75 and pulling out the mounting screw 74.

The locks 44 and 45 are placed in contact with the piston pump cover portion 33, the mounting screw 74 is inserted into the screw insert holes 70*a*, 71*a* and 73*a* and the nut 75 is tightened whereby the locks can be quickly mounted on the piston pump cover portion 33.

What is claimed is:

1. A sprayer comprising:

a casing encasing an electromagnetic operated mechanism having a grip and a power switch and including a coil wound around a fixed core and a movable iron piece;

a piston pump comprising a cylinder formed in it front portion with a cylinder mounting pin contacting recess, a piston capable of being moved forward by said movable iron piece, a return spring interposed between a rear end of the cylinder and a flange portion of the piston and being wound around the piston and a valve set including a check valve, said piston pump being fitted in a piston pump cover portion formed in said casing;

a container mounting body mounted on said piston pump cover portion and having a supply through-hole in communication with a piston chamber of said piston pump and a return through-hole;

a coating container having a suction pipe for supplying a coating to said pump chamber, said suction pipe having an upper portion inserted into a suction pipe mounting portion having said supply through-hole and having a strainer provided on the lower end thereof; and a left lock and a right lock comprising a front lock portion having a cylinder mounting pin at the front end thereof and a rear lock portion in which a front end is pivotally mounted by means of a mounting pin to the rear end of said front lock portion, said rear lock portion being pivotally mounted at the front to the piston pump cover portion of said casing by means of said mounting pin through a mounting pin and being formed at the rear end with a knob, said left lock and said right lock being provided on opposite sides of said piston pump cover portion, whereby the rear lock portion of said left lock and said right lock are turned frontwardly in a horizontal plane to release the cylinder mounting pin of the front lock portion from the cylinder mounting pin contacting recess so that a nozzle head, a cylinder, a piston and a valve set can be removed.

2. A sprayer comprising:

a casing encasing an electrogmagnetic operated mechanism having a grip and a power switch and including a coil wound around a fixed core and a movable iron piece;

a piston pump comprising a cylinder formed in its front portion with a cylinder mounting mounting pin contacting recess, a piston capable of being moved forward by said movable iron piece, a return spring interposed between a rear end of the cylinder and a flange portion of the piston and being wound around the piston and a valve set including a check valve, said piston pump being fitted in a piston pump cover portion formed in said casing;

a container mounting body mounted on said piston pump cover portion and having a supply through-hole in communication with a piston chamber of said piston pump and a return through-hole;

a coating container having a suction pipe for supplying a coating to said pump chamber, said suction pipe having an upper portion inserted into a suction pipe mounting portion having said supply through-hole and having a strainer provided on the lower end thereof; and a left lock and a right lock each comprising a front lock portion having a cylinder mounting pin at the front end thereof and a rear lock portion in which a front end is pivotally mounted by means of a connecting pin to the rear end of said front lock portion, a screw insert body pivoted ahead of said connecting pin through a mounting pin is provided and a knob portion is formed at the rear end;

wherein a front screw insert portion formed in said piston pump cover portion, a rear screw insert portion formed in a stopper cover portion of said casing and a screw insert body attached to said rear lock portion are made to be coaxial with each other, a mounting screw is inserted into the front screw insert portion, the screw insert body and the rear screw insert portion and tightened, whereby the rear lock portions of said left lock and said right lock are turned frontwardly in a horizontal plane to release the cylinder mounting pin of the front lock portion from the cylinder mounting pin contacting recess so that a nozzle head, a cylinder, a piston and a valve set can be removed, and said left lock and said right lock are freely mounted or removed by the mounting screw inserted into said front screw insert portion, said screw insert body and said rear screw insert portion.

3. A sprayer comprising:

a casing encasing an electromagnetic operated mechanism having a grip and a power switch and including a coil wound around a fixed core and a movable iron piece;

a piston pump comprising a cylinder formed in its front portion with a cylinder mounting pin contacting recess, a piston capable of being moved forward by said movable iron piece, a return spring interposed between a rear end of the cylinder and a flange portion of the piston and being wound around the piston and a valve set including a check valve, said piston pump being fitted in a piston pump cover portion formed in said casing;

a container mounting body mounted on said piston pump cover portion and having a supply through-hole in communication with a piston chamber of said piston pump and a return through-hole;

a coating container having a suction pipe for supplying a coating to said pump chamber, said suction pipe having an upper portion inserted into a suction pipe mounting portion having said supply through-hole and having a strainer provided on the lower end thereof;

an adjusting rod engaged with said movable iron piece to adjust a stroke of the piston; and a left lock and a right lock comprising a front lock portion having a cylinder mounting pin at the front end thereof and a rear lock portion in which a front end is pivotally mounted by means of a mounting pin to the rear end of said front lock portion, said rear lock portion being pivotally mounted at the front to the piston pump cover portion of said casing by means of said mounting pin through a mounting pin and being formed at the rear end with a knob, said left lock and said right lock being provided on opposite sides of said piston pump cover portion, whereby the rear lock portions of said left lock and said right lock are turned frontwardly in a horizontal plane to release the cylinder mounting pin of the front lock portion from the cylinder mounting piston contacting recess so that a nozzle head, a cylinder, a piston and a valve set can be removed.

4. A sprayer comprising:

a casing encasing an electromagnetic operated mechanism having a grip and a power switch and including a coil wound around a fixed core and a movable iron piece;

a piston pump comprising a cylinder formed in its front portion with a cylinder mounting pin contacting recess, a piston capable of being moved forward by said movable iron piece, a return spring interposed between a rear end of the cylinder and a flange portion of the piston and being wound around the piston and a valve set including a check valve, said piston pump being fitted in a piston pump cover portion formed in said casing;

a container mounting body mounted on said piston pump cover portion and having a supply through-hole in communication with a piston chamber of said piston pump and a return through-hole;

a coating container having a suction pipe for supplying a coating to said pump chamber, said suction pipe having an upper portion inserted into a suction pipe mounting portion having said supply through-hole and having a strainer provided on the lower end thereof;

an adjusting rod engaged with said movable iron piece to adjust a stroke of the piston; and a left lock and a right lock each comprising a front lock portion having a cylinder mounting pin at the front end thereof and a rear lock portion in which a front end is pivotally mounted by means of a connecting pin to the rear end of said front lock portion, a screw insert body pivoted ahead of said connecting pin through a mounting pin is provided and a knob portion is formed at the rear end;

wherein a front screw insert portion formed in said piston pump cover portion, a rear screw insert portion formed in a stopper cover portion of said casing and a screw insert body attached to said rear lock portion are made to be coaxial with each other, a mounting screw is inserted into the front screw insert portion, the screw insert body and the rear screw insert portion and tightened, whereby the rear lock portions of said left lock and said right lock are turned frontwardly in a horizontal plane to release the cylinder mounting pin of the front lock portion from the cylinder mounting pin contacting recess so that a nozzle head, a cylinder, a piston and a valve set can be removed, and said left lock and said right lock are freely mounted or removed by the mounting screw inserted into said front screw insert portion, said screw insert body and said rear screw insert portion.

5. A sprayer according to any one of the claims 1 to 4 wherein the front lock portion and the rear lock portion of said left lock and said right lock comprise a plastic cover to which a metal base plate is connected.

* * * * *